United States Patent [19]

Tagalakis et al.

[11] 4,089,434

[45] May 16, 1978

[54] VENTING LINER

[75] Inventors: Peter Tagalakis, Villa Park; James Woods, Oswego, both of Ill.

[73] Assignee: Seling Sealing Products, Inc., Forrest, Ill.

[21] Appl. No.: 749,371

[22] Filed: Dec. 10, 1976

[51] Int. Cl.[2] ..... B65D 51/16

[52] U.S. Cl. ..... 215/260; 215/347; 428/64; 428/159; 428/163

[58] Field of Search ..... 215/260, 261, 347; 220/304, 366, 373; 428/64, 66, 158, 159, 160, 163

[56] References Cited

U.S. PATENT DOCUMENTS

| | | | |
|---|---|---|---|
| 2,265,862 | 12/1941 | Rosentreter | 215/260 |
| 2,270,714 | 1/1942 | Bellg | 215/347 |
| 3,045,854 | 7/1962 | Patton | 215/260 |

*Primary Examiner*—Donald F. Norton

*Attorney, Agent, or Firm*—Diller, Brown, Ramik & Wight

[57] ABSTRACT

This invention is directed to a liner for venting excessive internal pressure of an associated container, the liner including three plies of plastic material in which a first ply formed of foam plastic is sandwiched between second and third plies which are impermeable, the second ply including a plurality of indentations opening in a direction away from the third ply, such that the material in the areas of the indentations of the first ply are compressively deformed whereas second areas of the first ply are generally uncompressed or less compressed whereby when the liner is associated with a container and closure venting is permitted either through vents formed between a sealing lip of the container and the first or second areas depending upon the axial load of the closure relative to the container as determined by the torque involved in applying the closure to the container.

22 Claims, 11 Drawing Figures

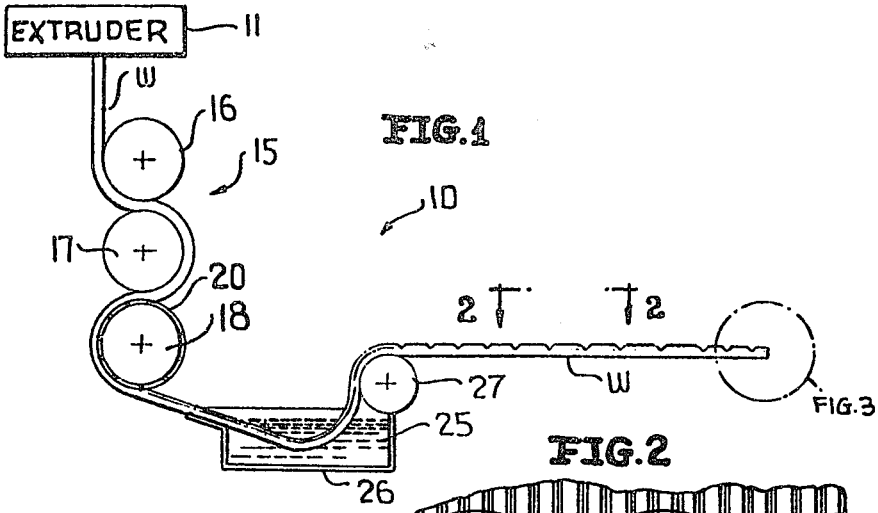
FIG.1
FIG.2
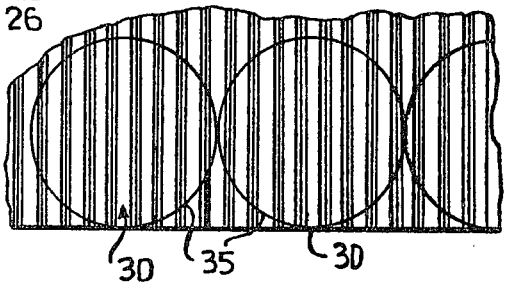
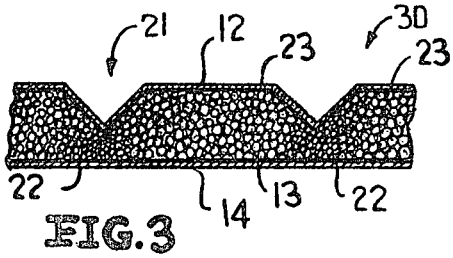
FIG.3
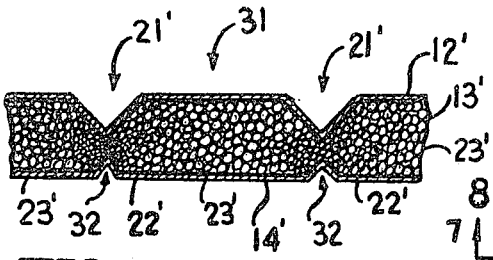
FIG.4
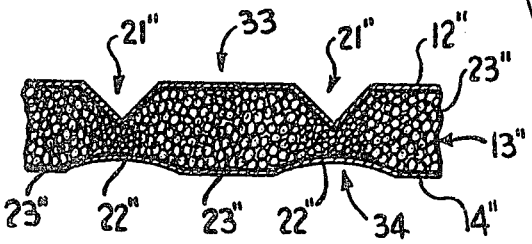
FIG.5
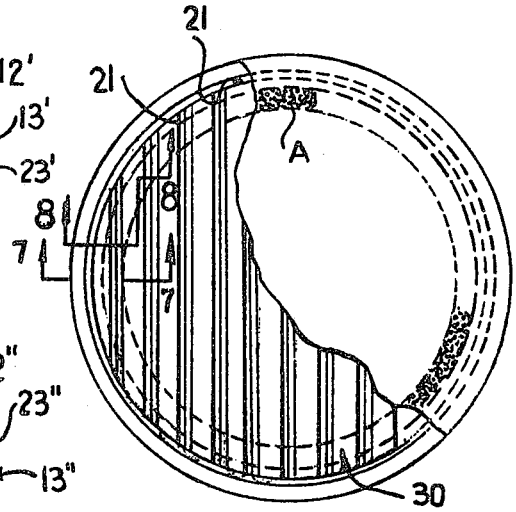
FIG.6

VENTING LINER

Venting liners are relatively well known and are designed essentially to maintain a hermetic seal between a container finish lip and a surface of the venting liner overlying the same. However, should the container be packaged with a product which evolves a gas or is simply under pressure which might increase excessively under certain conditions (elevated temperature), it is desirable for the hermetic seal to be broken to permit excessive internal pressure to vent to atmosphere, thus precluding breakage of the closure or container.

A major problem of conventional venting liners is there inability to vent with consistency at a particular internal pressure or a limited range of internal pressures within an associated container. One reason for this is the difficulty of applying each closure to an associated container with a particular torque so that the force across the circumferential sealing surface between the venting liner and the container lip is uniform for all container-liner-closure packages. If a closure is threaded, for example, to a container with excessive torque, a generally excellent hermetic seal would be obtained, but under excessive internal pressure, venting might not occur and the container might burst, the closure could be blown therefrom, or if the container were made of plastic material, it would be deformed sufficiently to render it commercially unacceptable to the consuming public. Contrarywise, if the closing torque applied to the closure is too low, a hermetic seal might not be obtained, but more importantly, where the venting liner is associated with a pressurized product, the pressure media, such as an inner gas employed to protect the integrity of the packaged product, would escape to atmosphere when such is not desired, thus, rendering the product unusable or of a lesser quality than might be commercially acceptable.

Apart from the problems heretofore set forth relative to conventional venting liners, it is also well known to provide liners which simply are not designed for venting purposes. Thus, a packager who desires to package products under venting and non-venting conditions must have in stock, both types of liners, namely, venting and non-venting. This is an obvious disadvantage since both types of liners must be stocked by the packager and selected for the particular purpose intended.

In view of the foregoing, it is a primary object of this invention to eliminate the disadvantages heretofore noted by providing a novel venting liner which vents under any closure applied torques while at the same time being capable of utilization as a non-venting liner.

Still another object of this invention is to provide a novel liner of the type aforesaid formed as a disc-shaped member defined by at least three plies of plastic material having therein a plurality of indentations formed by first compressively deformed areas and second areas which are generally uncompressed or lessed compressed than the first areas whereby upon application between a sealing lip of a container and an end panel of a closure, venting occurs under generally all ranges of closure application torque.

Still another object of this invention is to provide a novel liner of the type heretofore set forth wherein a first of the plies is constructed of foam material and is sandwiched between second and third of the plies which are composed of impermeable material.

Yet another object of this invention is to provide a novel liner of the type aforesaid wherein the first ply in areas of the indentations is denser than in the generally uncompressed or less compressed areas.

With the above and other objects in view that will hereinafter appear, the nature of the invention will be more clearly understood by reference to the following detailed description, the appended claimed subject matter, and the several views illustrated in the accompanying drawings.

In the Drawings:

FIG. 1 is a schematic side elevational view of an apparatus for producing liners in accordance with this invention, and illustrates a three-roll polishing station through which passes a three-ply web of extruded materials with one of the webs carrying ridges for forming indentions in the web prior to the solidification thereof.

FIG. 2 is an enlarged fragmentary top plan view taken generally along line 2—2 of FIG. 1, and more clearly illustrates the indentations.

FIG. 3 is an enlarged fragmentary sectional view of the encircled portion of FIG. 1, and illustrates the indentations more clearly along with dense foamed material in the regions thereof with less dense foamed material therebetween.

FIG. 4 is a fragmentary sectional view similar to FIG. 3, and illustrates opposing indentations of the material.

FIG. 5 is a fragmentary sectional view similar to FIG. 4, and likewise illustrates opposed indentations of the material.

FIG. 6 is a fragmentary top plan view of a liner constructed from the material of FIGS. 2 and 3, and illustrates the indentations opening in an upward direction.

Figure 7:
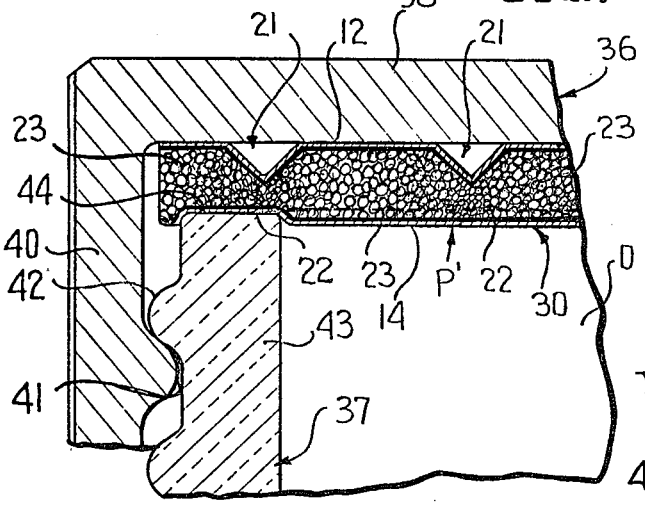
FIG. 7 is an enlarged fragmentary sectional view taken generally along line 7—7 of FIG. 6, and more clearly illustrates the indentations in opposed opening relationship to an end panel of a closure secured to a container body.
Figure 9:
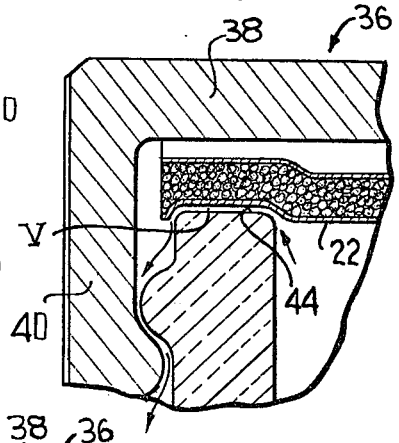
FIG. 9 is a fragmentary sectional view taken generally along line 9—9 of FIG. 8, and more clearly illustrates the manner in which the venting occurs.
Figure 8:
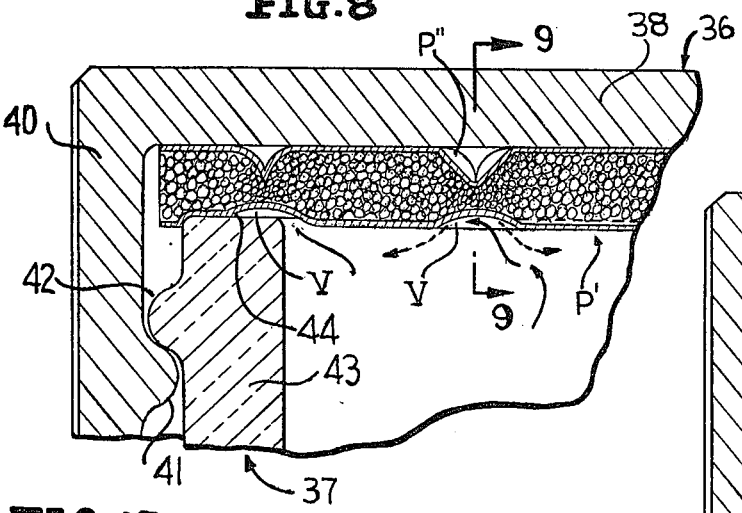
FIG. 8 is a fragmentary sectional view similar to FIG. 7, and illustrates the manner in which a hermetic seal between the liner and a sealing lip of the container body is broken to permit venting under moderate closure torques of the closure.

Reference is first made to FIG. 1 of the drawings which illustrates schematically a machine, generally designated by the reference numeral 10, for forming a web W, the machine including a conventional extruder 11 which extrudes three plies or laminates 12, 13, 14 (FIG. 3). The web W is directed through a three-roll polishing station, generally designated by the reference numeral 15 which includes polishing rolls 16, 17 and 18, the latter of which includes a plurality of radially outwardly directed ribs or projections 20. The ribs or projections 20 extend generally the entire axial length of the roll 18. As the web W passes between the rolls 17, 18, the ribs 20 form indentations, generally designated by the reference numeral 21, in the ply 12 and the ply 13 (FIG. 3). Preferably the plies 12, 14 are constructed from impermeable polymeric or copolymeric material while the ply 13, though constructed of polymeric or copolymeric material, is preferably foamed, typical of such material being polyethylene, polypropylene, etc. Due to the ribs 20 which form the indentations 21, areas 22 immediately adjacent the indentations 21 of the ply 13 are compressed and the density thereof increases as does the rigidity since the air cells (unnnumbered) of the foamed material are reduced in volume. Areas 23 between the areas 22 which are generally uncompressed or less compressed than the areas 22 are of greater density and lesser rigidity than the areas 22.

After the web W passes beyond the roll 18, it is immersed in coolant 25 within a reservoir 26 which sets the material and renders it generally stable for subsequent processing operations. The web W is guided from the coolant (water) 25 of the reservoir 26 over a roll 27 and subsequently therefrom are stamped a plurality of liners 30 (FIG. 2) which are of a generally disc-shaped configuration.

Another web or disc 31 (FIG. 4) is constructed from the same material as the web or disc 30 and thus like reference numerals have been applied to the various elements thereof with the same primed. The web or disc 31 differs from the disc 30 in that the ply 14' includes a plurality of indentations 32 which are in line with the indentations 21 and are of a lesser depth. Depending upon the specific materials involved, the web 31 as it passes from between the rolls 17, 18 is no longer effected by the compression at the bight portion between the rolls. Upon the release of this compression, there is a tendency during the cooling of the web 31 in the coolant 25 for the areas 22' to contract and thus cause the ply 14' to be drawn slightly in the areas 22' thus obtaining the generally configuration of the indentations 32.

Another disc or web 33 is identical to the disc or web 31 except that indentations 34 thereof are of a generally outwardly opening shallow concave configuration.

Both with respect to the discs 31 and 32, the respective indentations 21', 32 and 21'', 34 are coextensive in length.

In each of the webs or liners 30, 31, 33, the indentations 21, 21', 21'', 32 and 34 are illustrated as being in parallel relationship to each other extending the entirety of the discs, but in keeping with this invention the latter-noted indentations need not be parallel so long as portions thereof project beyond peripheries 35 of the liners.

Reference is now made to FIGS. 6 through 9 of the drawings which illustrates the disc 30 associated with a closure 36 and a container 37. The closure 36 includes an end panel 38, a depending peripheral skirt 40, and internal ribs or lugs 41 which function to secure the closure 36 to similar threads or lugs 42 of a container body 43 of the container 37. An opening, generally designated by the reference numeral 0 is circumscribed by a sealing lip 44. The venting liner 30 is disposed between the end panel 38 of the closure 36 and the sealing lip 44 of the container body 43. It is to be noted that the ply 14 defines a hermetic seal with the sealing lip 44 and that the indentations 21 open upwardly toward the end panel 38 of the closure 36. The stipled circumferential area A (FIG. 6) defines that area at which a hermetic seal is obtained between the impermeable ply 14 and the sealing lip 44.

The closure 36 is threaded upon the container body 43 by a relatively moderate torque and thus the liner 30 in the circumferential sealing area A is deformed relatively slightly as are the indentations 21. However, the indentations 21 in the closed position of the liner 30 shown in FIG. 7 open through the periphery 35 of the closure 30.

Assuming that a product P packaged within the contained 37 is of a gas evolving nature or, alternatively, that an inert gas which tends to increase in pressure under certain conditions is packaged within the container, the pressure P' thereof acting upon the underside of the liner 30 bears equally against the areas 22, 23. However, due to the indentations 21 and the more dense nature of the areas 22, the liner 30 in the area of the indentations 21 raises at one or more points along the circumferential sealing area A to provide one or more vent openings V permitting the escape of gas in the manner best illustrated in FIGS. 8 and 9. It is particularly pointed out that this raising of the liner 30 in the area of the indentations 21 only occurs in the general area of the circumferential sealing area A, not across the entirety of the length of the indentations, as is readily apparent from the right-handmost illustrated indentation 21 of FIG. 8 in which the reference character P'' indicates only those areas of the indentations 21 at the circumferential sealing area A.

Figure 11:
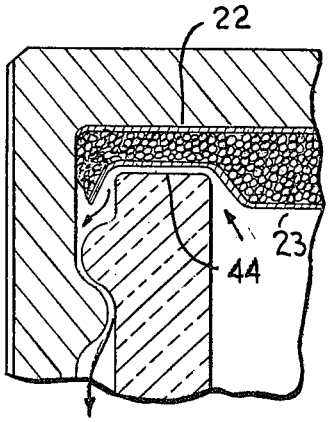
FIG. 11 is a fragmentary sectional view taken generally along line 11—11 of FIG. 10, and more clearly illustrates the venting between the liner and the sealing lip.
Figure 10:
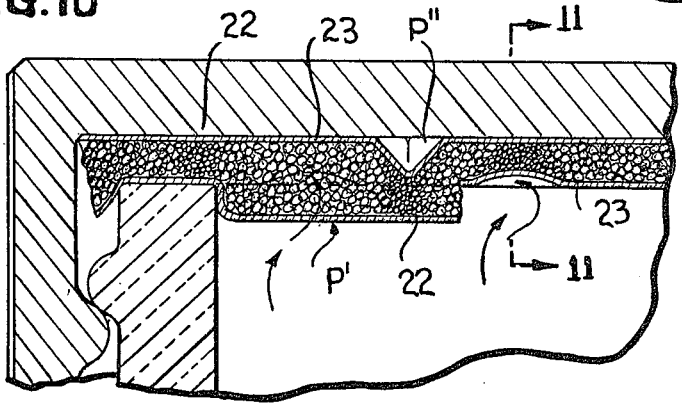
FIG. 10 is a fragmentary sectional view similar to FIG. 8, but illustrates the manner in which venting occurs when the closure is applied under high closure torques.

Reference is now made to FIGS. 10 and 11 of the drawings which illustrates the venting liner 30 associated with the identical closure 36 and container 37. However, due to a higher closing torque applied to the closure 36 of FIGS. 10 and 11, as compared to the more moderate closing torque applied to the closure 36 of FIGS. 7 through 9, the liner 30 in the circumferential sealing area A is deformed more excessively than that of the liner 30 of FIGS. 7 through 9, as readily apparent from a comparison of FIGS. 7 and 10. Due to this vastly higher compression of the liner 30 of FIGS. 10 and 11, the indentations 21 are closed (FIG. 10) over the entire circumferential sealing area A. This is again illustrated by the portion P'' of each indentation 21 in FIGS. 6 and 10. Since the portions P'' about the entire circumferential sealing surface A are virtually closed and the area 22 associated therewith is relatively rigid, the pressure P' acting upon the underside of the liner 30 has little, if any, effect toward dislodging the hermetic seal at the areas 22. However, the softer, less dense, and more yieldable areas 23 are urged upwardly and at one or more of the areas 23, the hermetic seal is broken to create a vent V with the result that any excessive pressure within the container 37 can be vented to atmosphere. Thus, irrespective of light, moderate or high torques, venting is assured under most if not all closure application torques.

Quite obviously, if the liner 30 is to be utilized for non-venting applications, the hermetic seal between the sealing lip 44 and the impermeable ply 14 cannot be disturbed other than, of course, by the intentional removal of the closure 36.

The venting liners 31 and 33 of FIGS. 4 and 5, respectively, operate in the manner identical to that described relative to the venting liner 30. However, in the case of the venting liners 31, 33, during the lowest closure application torque, the indentations 32, 34 collapse and fully close to present a uniplanar sealing surface which creates a hermetic seal with the sealing lip 44 of the container 37.

Though the indentations 21 have been illustrated as being generally V-shaped in transverse cross-section, these may be modified in configuration so long as the same open in a direction away from the ply 14. Moreover, the indentations 21 may be in a crossed pattern, a rectangular pattern, or the like so long as at least portions P″ thereof span the circumferential sealing area. A between the end panel 38, the closure 36 and the lip 44 of the container 37.

While preferred forms and arrangement of parts have been shown in illustrating the invention, it is to be clearly understood that various changes in details and arrangement of parts may be made without departing from the scope and spirit of this disclosure.

I claim:

1. A venting liner for a closure comprising a disc-shaped member, said disc-shaped member being defined by at least three plies of polymeric or copolymeric material, a first of said plies being sandwiched between second and third of said plies, the plastic material of said second and third plies being impermeable, the plastic material of said first ply being deformable when subject to a compressive force, said second ply including a plurality of indentations opening in a direction away from said third ply, first areas of said first ply between said indentations and said third ply being compressively deformed, and second areas of said first ply being generally uncompressed or less compressed than said first areas.

2. The venting liner as defined in claim 1 wherein the material of said first ply is foamed.

3. The venting liner as defined in claim 1 wherein the material of said first ply is foamed, said first areas of a predetermined density, and said second areas are of a lesser density than said predetermined density.

4. The venting liner as defined in claim 3 wherein said three plies are a simultaneously extruded and bonded laminate.

5. The venting liner as defined in claim 1 wherein said three plies are a simultaneously extruded and bonded laminate.

6. The venting liner as defined in claim 4 wherein said indentations are in general parallel relationship to each other.

7. The venting liner as defined in claim 4 wherein said indentations are generally V-shaped in transverse cross-section.

8. The venting liner as defined in claim 1 wherein said indentations are in general parallel relationship to each other.

9. The venting liner as defined in claim 1 wherein said indentations are generally V-shaped in transverse cross-section.

10. The venting liner as defined in claim 1 including a plurality of indentations in said third ply opening in a direction away from said second ply, and said first-mentioned and last-mentioned indentations are in alignment with each other.

11. A combined container and closure comprising a container body including an opening circumscribed by a circumferential sealing lip, a closure including an end panel and a peripheral skirt, means removably securing said closure to said container body in closed relationship to said opening, a venting liner disposed between said end panel and said sealing lip, said venting liner comprising a disc-shaped member, said disc-shaped member being defined by at least three plies of polymeric or copolymeric material, a first of said plies being sandwiched between second and third of said plies, the plastic material of said second and third plies being impermeable, the plastic material of said first ply being deformable when subject to a compressive force, said second ply including a plurality of indentations opening in a direction away from said third ply, first areas of said first ply between said indentations and said third ply being compressively deformed, second areas of said first ply being generally uncompressed or less compressed than said first area, said indentations open in a direction toward said end panel, said third ply being in hermetic sealing engagement with said sealing lip over the entire circumferential sealing area of the latter, said closure being secured to said container body under moderate axial load whereby portions of said indentations within said circumferential sealing area are open and upon excessive internal pressure within said container body said third ply of at least one of said first areas within said circumferential sealing area raises to break the hermetic seal and permit venting to atmosphere of the internal pressure.

12. The container and closure combination as defined in claim 11 wherein the material of said first ply is foamed.

13. The container and closure combination as defined in claim 11 wherein the material of said first ply is foamed, said first areas are of a predetermined density, and said second areas are of a lesser density than said predetermined density.

14. The container and closure combination as defined in claim 11 wherein said three plies are a simultaneously extruded and bonded laminate.

15. The container and closure combination as defined in claim 11 wherein said indentations are in general parallel relationship to each other.

16. The container and closure combination as defined in claim 11 wherein said indentations are generally V-shaped in transverse cross-section.

17. A combined container and closure comprising a container body including an opening circumscribed by a circumferential sealing lip, a closure including and end panel and a peripheral skirt, means removably securing said closure to said container body in closed relationship to said opening, a venting liner disposed between said end panel and said sealing lip, said venting liner comprising a disc-shaped member, said disc-shaped member being defined by at least three plies of polymeric or copolymeric material, a first of said plies being sandwiched between second and third of said plies, the plastic material of said second and third plies being impermeable, the plastic material of said first ply being deformable when subject to a compressive force, said second ply including a plurality of indentations opening in a direction away from said third ply, first areas of said first ply between said indentations and said third ply being compressively deformed, second areas of said first ply being generally uncompressed or less compressed than said first areas, said indentations open in a direction toward said end panel, said third ply being in hermetic sealing engagement with said sealing lip over the entire circumferential sealing area of the latter, said closure being secured to said container body under high axial load whereby portions of said indentations within said circumferential sealing areas are closed and upon excessive internal pressure within said container body said third ply of at least one of said second areas within said circumferential sealing area raises to break the hermetic seal and permit venting to atmosphere of the internal pressure.

18. The container and closure combination as defined in claim 12 wherein the material of said first ply is foamed.

19. The container and closure combination as defined in claim 12 wherein the material of said first ply is foamed, said first areas are of a predetermined density, and said second areas are of a lesser density than said predetermined density.

20. The container and closure combination as defined in claim 12 wherein said three plies are a simultaneously extruded and bonded laminate.

21. The container and closure combination as defined in claim 12 wherein said indentations are in general parallel relationship to each other.

22. The container and closure combinations as defined in claim 12 wherein said indentations are generally V-shaped in transverse cross-section.

* * * * *